US007179179B2

(12) United States Patent
McDaniel

(10) Patent No.: US 7,179,179 B2
(45) Date of Patent: Feb. 20, 2007

(54) DEVICE FOR IMPROVING PITCHING PERFORMANCE

(76) Inventor: David McDaniel, 1078 Litchfield Way, Marietta, GA (US) 30060

( * ) Notice: Subject to any disclaimer, the term of this patent is extended or adjusted under 35 U.S.C. 154(b) by 70 days.

(21) Appl. No.: 11/119,194

(22) Filed: Apr. 29, 2005

(65) Prior Publication Data

US 2006/0243929 A1 Nov. 2, 2006

(51) Int. Cl.
*A63B 69/00* (2006.01)

(52) U.S. Cl. ..... 473/456; 473/454; 473/422; 273/371

(58) Field of Classification Search ..... 473/454–456, 473/422, 434, 435; 273/348, 373, 374, 378, 273/382, 389, 408, 402
See application file for complete search history.

(56) References Cited

U.S. PATENT DOCUMENTS 4,199,141 A * 4/1980 Garcia ..... 473/455
4,830,369 A * 5/1989 Poitras ..... 473/455
4,930,174 A * 6/1990 Hunter ..... 5/708
5,046,729 A * 9/1991 Yancey ..... 473/455
D330,920 S * 11/1992 Schaefer et al. ..... D21/780
5,573,239 A * 11/1996 Ryker et al. ..... 473/436
5,672,125 A * 9/1997 Ross ..... 473/421
5,746,671 A * 5/1998 Ritchie ..... 473/454
6,155,936 A * 12/2000 Dorr ..... 473/456
6,551,205 B1 * 4/2003 Koelzer, Jr. et al. ..... 473/454
6,837,495 B2 * 1/2005 Gerson et al. ..... 273/372
7,056,239 B2 * 6/2006 Hickman, Jr. ..... 473/454
2004/0162166 A1 * 8/2004 Tien ..... 473/454

* cited by examiner

*Primary Examiner*—Mitra Aryanpour
(74) *Attorney, Agent, or Firm*—John L. James

(57) ABSTRACT

An air mattress has a resilient front panel, an opposed rear panel and at least one interior panel extending therebetween dividing the mattress into ball and strike chambers. A ball air valve attached to the rear panel at the ball chamber activates in response to a predetermined pressure increase in the chamber occurring in response to deflection of the front panel at the ball chamber. A strike air valve attached to the rear panel at the strike chamber activates in response to a predetermined pressure increase in the chamber occurring in response to deflection of the front panel at the strike chamber. Signaling devices alert when a strike or ball air valve activates informing a user whether a pitch is a ball or a strike.

17 Claims, 4 Drawing Sheets

DEVICE FOR IMPROVING PITCHING PERFORMANCE

FIELD OF THE INVENTION

The present invention relates generally to sporting equipment for baseball and softball, and, more particularly, to a device for practicing pitching and improving pitching performance.

BACKGROUND OF THE INVENTION

Baseball continues to be a favorite past time, and each year millions of youngsters dream of becoming a major league pitcher. So too, do many adults share the dream of joining the ranks of legendary pitchers. Even professional ball players who are already pitchers practice pitching to improve or maintain performance. Conventional pitching aids present a target for the pitcher that represents the strike zone. As the pitcher practices, he can visually judge which pitches are strikes. Sophisticated pitching aids give a visual or audible indication of a strike, and even more advanced pitching aids use computers to count balls and strikes. Unfortunately, as sophistication increases, cost also increases making the devices rather expensive for children desiring to improve pitching performance. Accordingly, it will be appreciated that it would be highly desirable to have a pitching aid that is affordable for the masses.

There are two major problems to be solved by a pitching aid. First, it is not enough to simply determine balls and strikes. It is necessary to pitch to the inside and outside of the strike zone as well as pitch up or down in the strike zone. A need thus exists for dividing the strike zone while keeping the device simple to use and relatively inexpensive. Second, it is desired to return the pitched ball to the pitcher in a controlled manner so that the pitcher can concentrate on the pitching without having to retrieve balls or dodge returning balls.

Conventional pitching aids have rigid metal frames that support the target or require a backstop that uses a screen mounted on a movable metal frame or permanently mounted on posts embedded in the ground. Embedded posts limit the mobility of the device making it useable only at the location where the posts are embedded. Metal frames are often too bulky for transports again limiting mobility, or require time, and sometimes expertise, to disassemble and reassemble. Accordingly, it will be appreciated that it would be highly desirable to have a pitching aid that is easily transported from one location, such as home, to another location, such a ball field or home of a friend or teammate.

SUMMARY OF THE INVENTION

Briefly summarized, according to one aspect of the present invention, a device for improving pitching performance, comprises an air vessel having a resilient front panel, an opposed rear panel and at least one interior panel extending between the front and rear panels dividing the vessel into at least one ball chamber and at least one strike chamber. A ball air valve is attached to the rear panel at the ball chamber. The ball air valve activates in response to a predetermined pressure increase in the ball chamber occurring in response to deflection of the front panel at the ball chamber. A strike air valve is attached to the rear panel at the strike chamber. The strike air valve activates in response to a predetermined pressure increase in the strike chamber occurring in response to deflection of the front panel at the strike chamber.

Signaling devices alert when a strike air valve activates and when a ball air valve activates so that a user knows whether a pitch is a ball or a strike.

According to another aspect of the invention, an apparatus for improving pitching performance comprises an air mattress having a resilient front panel with a strike zone and a ball zone thereon, an opposed rear panel and a plurality of interior panels extending between the front and rear panels internally dividing the mattress into a plurality of chambers. A number of the chambers are in the strike zone and a number of the chambers are in the ball zone. A bottommost chamber in the ball zone has a variable height to raise and lower the strike zone to accommodate different users.

A plurality of air valves are attached to the rear panel and distributed one valve per chamber with each air valve activating in response to a predetermined pressure increase in its associated chamber. The pressure increase occurs in response to deflection of the front panel at an associated chamber, such as when the front panel is struck by a pitched ball.

A signaling device signals when each air valve activates with the air valves in chambers in the ball zone giving a different signal than the air valves in chambers in the strike zone. A bell or buzzer works well as a signaling device. When the resilient front panel is partially transparent in the strike zone, then the signaling devices include a lighting device whose light is visible through the partially transparent front panel to give the pitcher a visual indication of balls and strikes.

A return panel is attached to the front panel along a bottom edge thereof and extends forward away from the front panel. A pitching mound is adapted for aligning with the strike zone in front of the front and return panels. The pitching mound has movable pads indicating where a pitcher's feet should come to rest after delivering a pitch. The return panel has a hard surface to help a pitched ball roll away from the mattress toward the pitcher's mound.

Flaps are attached to the mattress at the corners to anchor the mattress using ropes and stakes or anchors. When the mattress is deflated, it can be rolled or folded for transport with the ropes securing the roll.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
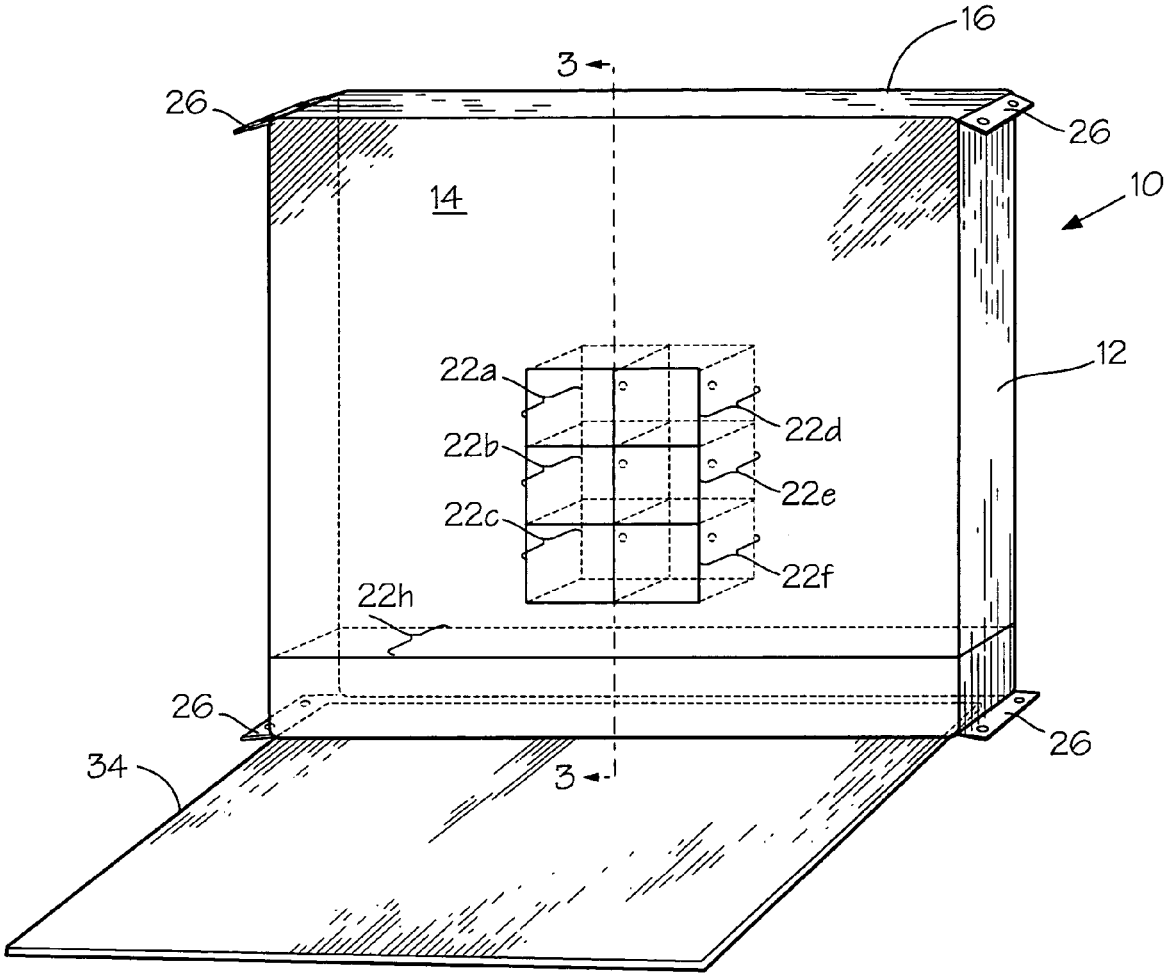
FIG. 1 is a perspective view of preferred embodiment of a pitching device according to the present invention.
Figure 2:
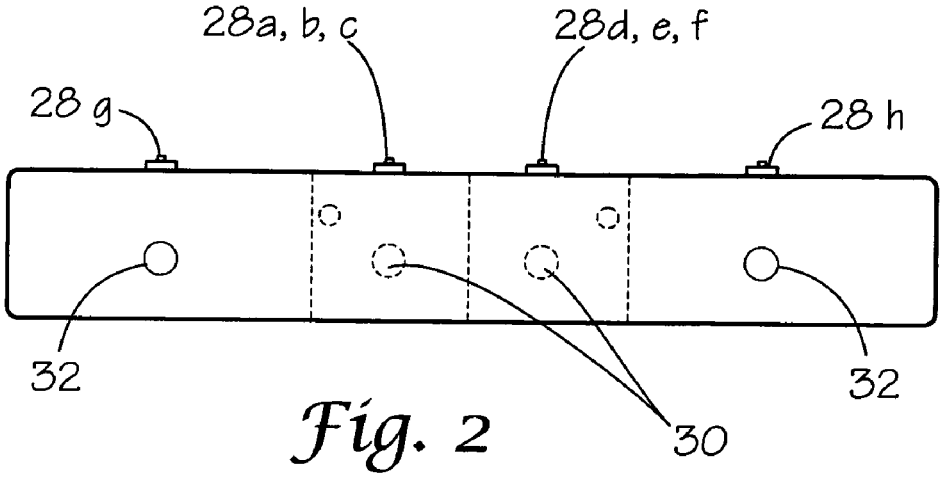
FIG. 2 is a diagrammatic top view of the pitching device of FIG. 1 illustrating air valves associated with the rear panel.
Figure 3:
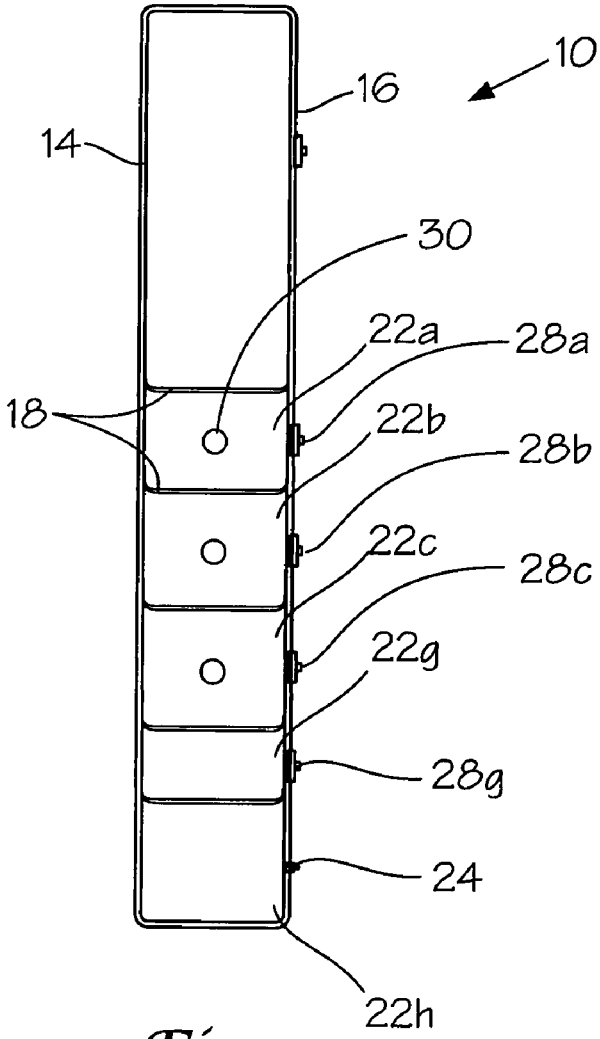
FIG. 3 is a sectional view taken along line 3—3 of FIG. 1.
Figure 4:
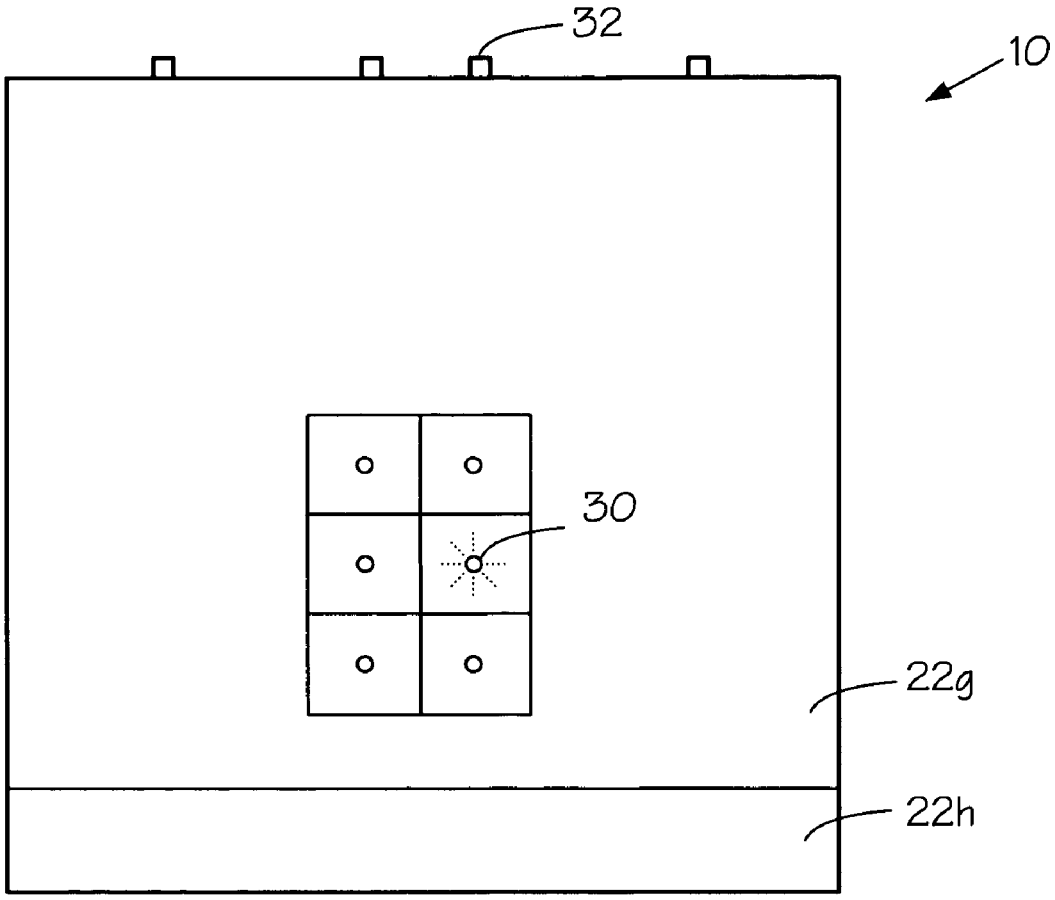
FIG. 4 is a diagrammatic front view of the pitching device of FIG. 1 illustrating visual and audio signaling device.

Referring to FIGS. 1–5, a device 10 for improving pitching performance uses an air vessel, such as air mattress 12 for example, that has a resilient front panel 14, an opposed rear panel 16 and a plurality of interior panels 18. Air mattress 12 may be constructed of canvas, plastic or polymeric materials, but vinyl is preferred. Front panel 14 has a strike zone and a ball zone thereon with the strike zone preferably being partially transparent or translucent to facilitate the use of lights inside to indicate a strike and its location. Front panel 14 is sufficiently resilient for a pitched ball to bounce away from it, but not so resilient as to rebound the ball so that the pitcher has to dodge it. Ideally, the pitched ball will land in front of the mattress with sufficient force to reach the pitcher as a ground ball.

The plurality of interior panels 18 extend between front and rear panels 14, 16 internally dividing mattress 12 into a plurality of chambers 22. As illustrated, six chambers, 22*a*–*f*, are in the strike zone and two chambers, 22*g*–*h*, are in the ball zone, but there could be as few as one chamber in the strike zone and one in the ball zone. There could be nine or more chambers in the strike zone, but, as a practical matter, considering costs, mobility and ease of use, nine strike chambers is sufficient. Using nine strike chambers allows the strike zone to be divided into upper, middle and lower zones, and further divided into left, center and right zones. Preferably, there are two chambers in the ball zone with the bottommost chamber 22*h* having a variable height so as to raise and lower the strike zone. Height may be varied by varying the pressure in ball chamber 22*h* via air valve 24.

Flaps 26 are attached to mattress 12 at the corners to anchor the mattress using ropes and stakes or weighted anchors. Once inflated, including bottom most chamber 22*h*, then the strike zone can be lowered by releasing air through valve 24 and raised again as needed. When the mattress is deflated, it can be rolled or folded for transport with the ropes securing the roll.

A plurality of air valves 28*a*–*h* are attached to the rear panel and preferably distributed one valve to each of the chambers 22*a*–*h*. Each the air valve activates in response to a predetermined pressure increase in its associated chamber occasioned by deflection of the front panel at the associated chamber. Such deflection occurs, for example, when a baseball strikes the front panel 14 at a chamber 22. The air valves may be positioned anywhere in a chamber they do not interfere with the deflecting front panel. Any of a variety of well known air valves or air switches may be used in keeping with the goal of having a relatively simple and economical device.

Lights 30 and buzzers 32 provide a means for signaling when an associated air valve activates. Lights 30 may be conventional lamps powered by a battery or solar cell, a light emitting diode array or other lighting device to give a visual indication. Buzzers 32 may be a buzzer, bell, horn, audio message or the like to give an audible indication. The air valves in chambers in the ball zone give a different signal than the air valves in the strike zone so the pitcher can easily distinguish between balls and strikes. Where the strike zone is subdivided, the signal given for one sub-zone must be distinguishable from the signal given for another sub-zone. When the resilient front panel is partially transparent in the strike zone, the means for signaling includes a lighting device 30 whose light is visible through the partially transparent front panel. By partially transparent it is meant that the light is visible through the front panel and that the front panel can be transparent, translucent or opaque with openings for the light to be seen.

A return panel 34 is attached to resilient front panel 14 along a bottom edge thereof and extends forward away from front panel 14 and away from rear panel 16. Return panel 34 can be folded or preferably rolled-up for transport and storage, but it has a smooth, hard surface so that a ball falling thereon from the air mattress rolls away from the mattress. The surface does not deaden the ball, rather it allows the ball to roll back towards the pitcher for the pitcher to field. The amount of energy in a return ball is dependent upon the speed at which the ball is thrown against the air mattress and the air pressure in the air mattress. When a pitcher wants to work on fielding, the pressure is increased to drop the ball on the return panel closer to the pitcher so that the ball has more energy to provide a challenge for the pitcher.

Figure 5:
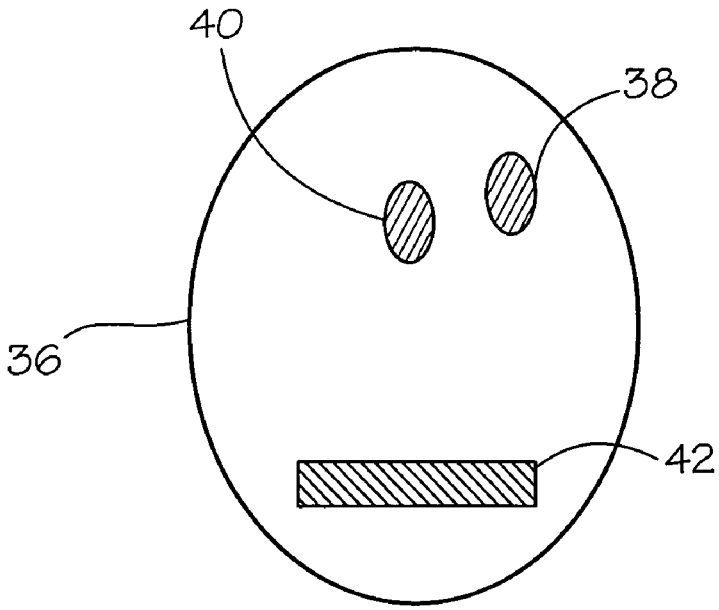
FIG. 5 is a portable pitching mound for use with the pitching device of FIG. 1.

Referring to FIG. 5, a pitching mound 36 is adapted for aligning with the strike zone in front of front panel 14 and return panel 34. The pitching mound 36 has first and second movable pads 38, 40 indicating where pitcher's feet come to rest after delivering a pitch. A pitcher's rubber or plate 42 is attached mound 36.

Figure 6:
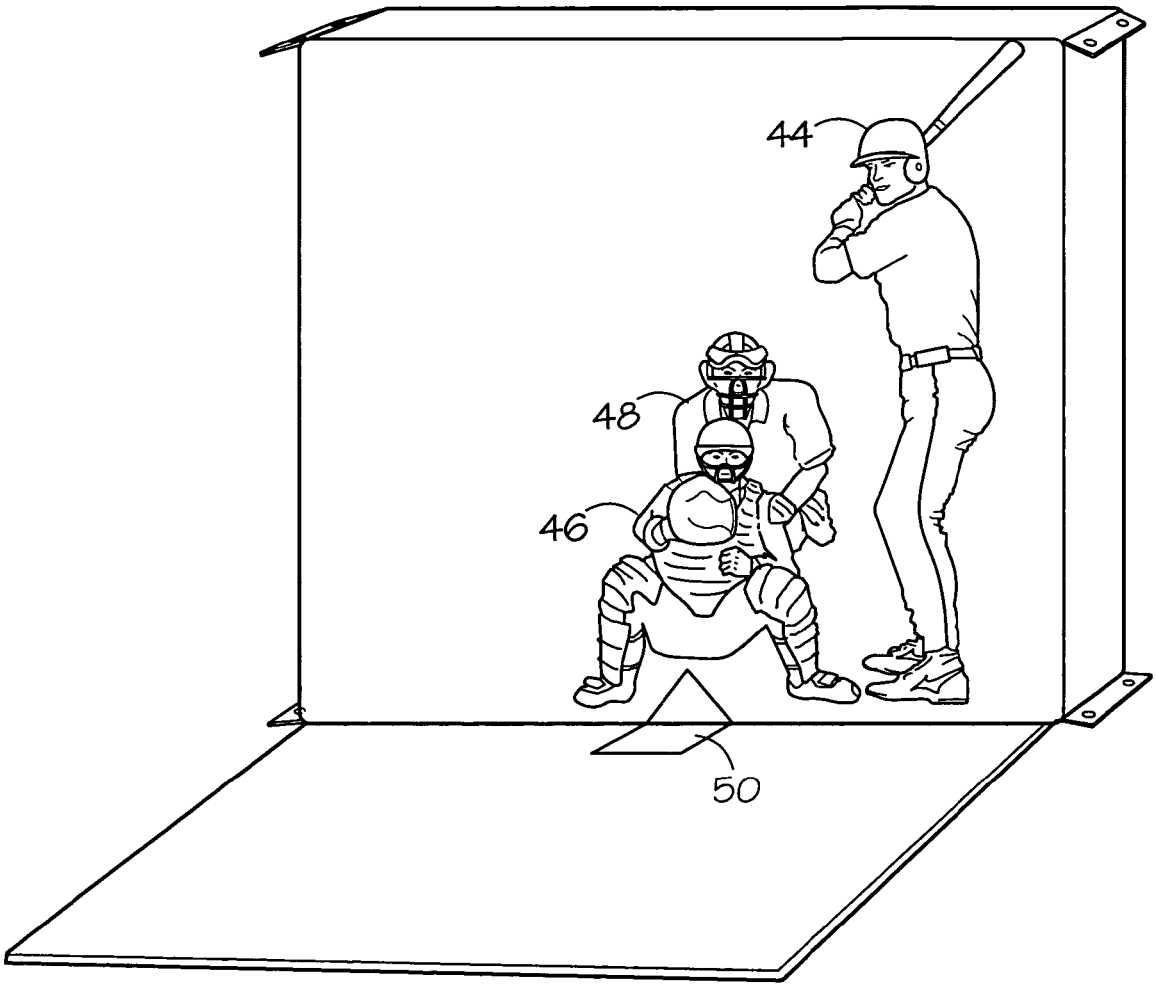
FIG. 6 is perspective view similar to FIG. 1 but having a simulated batter, catcher and umpire in position as during an actual game.

Referring to FIG. 6, to provide the pitcher with a more real life pitching experience, a batter 44, catcher 46, umpire 48 and home plate 50 can be imprinted on the air mattress. More preferably, batter 44 is a life size poster or other representation detachably mounted on the front surface by suitable means, such as a hook and loop fastener for example.

It can now be appreciated that a device for improving pitching performance has been presented that is relatively simple, easy to use and easily transported. When practicing, a pitcher can know whether each pitch is a ball or a strike and where in the strike zone the pitch falls. The device returns balls to the pitcher so that a pitcher can practice alone and concentrate solely on pitching without having to worry about retrieving the ball.

While the invention has been described with particular reference to the preferred embodiments, it will be understood by those skilled in the art that various changes may be made and equivalents may be substituted for elements of the preferred embodiments without departing from invention. For example, while the invention has been described in its basic form, it is apparent that a counter could be used to keep track of balls and strikes. It is accordingly intended that the claims shall cover all such modifications and applications as do not depart from the true spirit and scope of the invention.

ELEMENT LIST

10 device for improving pitching performance
12 air vessel, such as an air mattress
14 resilient front panel
16 rear panel
18 interior panels
20 vacant
22 chambers
22*a*–*f* strike zone chambers
22*g*–*h* ball zone chambers
24 air valve
26 flaps
28*a*–*g* air valves
30 lights
32 buzzers
34 return panel
36 pitching mound

38 first movable pad
40 second movable pad
42 pitcher's rubber or plate
44 batter
46 catcher
48 umpire
50 home plate

What is claimed is:

1. A device for improving pitching performance, comprising:

an air vessel having a resilient front panel, an opposed rear panel and at least one interior panel extending between said front and rear panels dividing said vessel into at least one ball chamber and at least one strike chamber;

a ball air valve attached to said rear panel at said ball chamber, said ball air valve activating in response to a predetermined pressure increase in said ball chamber, said pressure increase occurring in response to deflection of said front panel at said ball chamber;

means for signaling when said ball air valve activates;

a strike air valve attached to said rear panel at said strike chamber, said strike air valve activating in response to a predetermined pressure increase in said strike chamber, said pressure increase occurring in response to deflection of said front panel at said strike chamber; and means for signaling when said strike air valve activates.

2. A device, as set forth in claim 1, including:

a second interior panel extending between said front and rear panels below said at least one interior panel further dividing said vessel into a bottom ball chamber;

a bottom ball air valve attached to said rear panel at said bottom ball chamber, said bottom ball air valve activating in response to a predetermined pressure increase in said bottom ball chamber, said pressure increase occurring in response to deflection of said front panel at said bottom ball chamber; and means for signaling when said bottom ball air valve activates.

3. A device, as set forth in claim 2, wherein said bottom ball chamber collapses in response to a reduction in pressure therein to thereby lower said at least one strike chamber.

4. A device, as set forth in claim 1, including a panel attached to said front panel along a bottom edge thereof and extending forward away from said front panel.

5. A device, as set forth in claim 1, including a plurality of flaps attached to said vessel adapted to anchor said vessel.

6. A device, as set forth in claim 1, including a pitching mound adapted for aligning with said air vessel, said pitching mound having first and second movable pads indicating where pitcher's feet come to rest after delivering a pitch.

7. A device, as set forth in claim 1 wherein said resilient front panel is partially transparent.

8. A device, as set forth in claim 7, wherein means for signaling when said strike air valve activates is a lighting device whose light is visible through said partially transparent front panel.

9. A device for improving pitching performance, comprising:

an air mattress having a resilient front panel, an opposed rear panel and a first interior panel extending between said front and rear panels internally dividing said mattress into a ball chamber and a strike chamber;

a first air valve attached to said rear panel at said ball chamber, said first air valve activating in response to a predetermined pressure increase in said ball chamber, said pressure increase occurring in response to deflection of said front panel at said ball chamber;

a first signaling device adapted to provide a second signal when said second air valve activates;

a second air valve attached to said rear panel at said strike chamber, said second air valve activating in response to a predetermined pressure increase in said second chamber, said pressure increase occurring in response to deflection of said front panel at said strike chamber; and a second signaling device adapted to provide a second signal when said second air valve activates.

10. A device, as set forth in claim 9, including:

a second interior panel extending between said front and rear panels below said first interior panel further internally dividing said ball chamber into a bottom ball chamber;

a third air valve attached to said rear panel at said bottom chamber, said third air valve activating in response to a predetermined pressure increase in said bottom chamber, said pressure increase occurring in response to deflection of said front panel at said bottom chamber; and a third signaling device adapted to provide a second signal when said third air valve activates.

11. A device, as set forth in claim 10, wherein said bottom chamber collapses in response to a reduction in pressure therein to thereby lower said strike chamber.

12. A device, as set forth in claim 9, including a return panel having a hard surface and being attached to said front panel along a bottom edge thereof and extending forward away from said front panel.

13. A device, as set forth in claim 12, including a pitching mound adapted for aligning with said air mattress in front of said return, said pitching mound having first and second movable pads indicating where pitcher's feet come to rest after delivering a pitch.

14. A device, as set forth in claim 9, including a plurality of flaps attached to said mattress adapted to anchor said mattress.

15. An apparatus for improving pitching performance, comprising:

an air mattress having a resilient front panel with a strike zone and a ball zone thereon, an opposed rear panel; a plurality of interior panels extending between said front and rear panels internally dividing said mattress into a plurality of chambers, a number of said chambers being in said strike zone and a number of said chambers being in said ball zone, a bottommost chamber in said ball zone having a variable height to raise and lower said strike zone;

a plurality of flaps attached to said mattress adapted to anchor said mattress;

a plurality of air valves attached to said rear panel and distributed one valve to each of said chambers, each said air valve activating in response to a predetermined pressure increase in its associated chamber, said pressure increase occurring in response to deflection of said front panel at associated chamber;

means for signaling when each said air valve activates, said air valves in chambers in said ball zone giving a different signal than said air valves in said strike zone; and a return panel attached to said front panel along a bottom edge thereof and extending forward away from said front panel.

16. A device, as set forth in claim 15, wherein said resilient front panel is partially transparent in said strike zone; and wherein said means for signaling includes a lighting device whose light is visible through said partially transparent front panel.

17. A device, as set forth in claim 15, including a pitching mound adapted for aligning with said strike zone in front of said front and return panels, said pitching mound having first and second movable pads indicating where pitcher's feet come to rest after delivering a pitch.

* * * * *